US005409065A

United States Patent [19]

Davis

[11] Patent Number: 5,409,065

[45] Date of Patent: Apr. 25, 1995

[54] APPARATUS AND METHOD FOR RETRIEVING AN OBJECT FROM A WELL BORE, AND METHOD FOR MAKING A TOOL FOR RETRIEVING OBJECTS FROM A WELL BORE

[75] Inventor: Bob Davis, Hobbs, N. Mex.

[73] Assignee: WADA Ventures, Hobbs, N. Mex.

[21] Appl. No.: 245,638

[22] Filed: May 18, 1994

[51] Int. Cl.[6] ..... E21B 31/00; E21B 31/18

[52] U.S. Cl. ..... 166/301; 166/99; 166/380

[58] Field of Search ..... 166/301, 98, 99, 178, 166/379, 380; 294/86.26, 86.22, 86.1; 29/428, 456

[56] References Cited

U.S. PATENT DOCUMENTS

| | | | |
|---|---|---|---|
| 2,304,793 | 12/1942 | Bodine, Jr. | 166/301 X |
| 2,650,129 | 8/1953 | Axelsen | 294/86.1 |
| 3,358,765 | 12/1967 | Le Blanc | 166/301 |
| 3,393,002 | 7/1968 | Woolley | 166/98 X |
| 3,417,822 | 12/1968 | Howell | 166/301 |
| 5,020,599 | 6/1991 | Lau | 166/301 |

*Primary Examiner*—Stephen J. Novosad
*Attorney, Agent, or Firm*—Burns, Doane, Swecker & Mathis

[57] ABSTRACT

An apparatus for retrieving objects from well bores includes an uppermost segment having an internally threaded opening extending upwardly from a bottom end of the uppermost segment to a first location above the bottom end. One or more additional segments are provided. Each of the additional segments have top and bottom ends and are removably attachable, at a top end of each additional segment, to a bottom end of one of an upper one of the additional segments and the uppermost segment. Each of the additional segments have a tapered, internally threaded opening extending between the top end and the bottom end of the additional segments. A top end of the uppermost segment is secured to a bottom end of a rotatable down-hole drill rod and is lowered down around and rotated relative to an object to be retrieved such that threads on the tapered, internally threaded opening engage with the object. A method for using the apparatus and a method for making a retrieving tool are also disclosed.

22 Claims, 2 Drawing Sheets

APPARATUS AND METHOD FOR RETRIEVING AN OBJECT FROM A WELL BORE, AND METHOD FOR MAKING A TOOL FOR RETRIEVING OBJECTS FROM A WELL BORE

FIELD OF THE INVENTION

The present invention relates to apparatus and methods for retrieving an object from a well bore, and to a method for making a tool for retrieving objects from a well bore.

BACKGROUND AND SUMMARY OF THE INVENTION

In oil well operations, it is often necessary to retrieve objects from deep well bores. Typically, the objects in the well bore are portions of drilling equipment such as drill rods having an internal and an external diameter. In the oil well drilling industry, the practice of retrieving such objects is often referred to as "fishing", and the object to be retrieved is referred to as a "fish".

One of the more common fishing techniques involves the use of a tapered tap fishing tool. The tapered tap fishing tool is normally a single three to four foot long section, with case hardened threads on the outside diameter of the section. The outside diameter increases from approximately one inch at a bottom nose to approximately four or five inches at the top. The tapered tap fishing tool is mounted on a bottom end of a rotatable down-hole drill rod and is put down the hole until the taper reaches the object to be retrieved. The taper enters the internal diameter of the fish and is rotated so that the case hardened, tapered threads tap the inside of the fish. The taper cuts threads into the softer material of the fish and engages the fish by screwing into the newly cut threads. When the fishing tool and the fish are so engaged, the fish can be withdrawn from the well bore.

Another technique for retrieving objects from well bores involves the use of box tap fishing tools. The box tap fishing tool differs from the tapered tap fishing tool in that the box tap fishing tool has a single section with a tapered, threaded internal diameter, with case hardened threads. The box tap fishing tool engages an exterior of the fish, unlike the tapered tap fishing tool, which is only capable of use on fish having internal diameters. Accordingly, the box tap fishing tool is a more versatile fishing tool than the tapered tap fishing tool.

Known box tap fishing tools tend to be shorter than tapered tap fishing tools and have a larger angle of taper than the tapered tap fishing tools. As a result, box tap fishing tools suffer the disadvantage of generally engaging fewer threads with the fish, and it is therefore more difficult to fish for heavier or more securely stuck fish with box tap fishing tools. One reason for the higher angle taper and the shorter length of the box tap fishing tools is the difficulty of boring and threading the internal diameter of the box tap fishing tools. Further, it is quite expensive to form tapered, threaded internal diameters of significant lengths. Because fishing tools are generally subjected to quite harsh use conditions, which frequently result in damage to the tools that renders them unusable, it is presently difficult to justify the expense of machining long internally threaded, tapered diameters in box tap fishing tools.

In view of the above-described disadvantages of known fishing tools, it is desirable to provide a fishing tool combining the advantages of the box tap fishing tool with the ability to engage a fish with a large number of threads of the tapered tap fishing tool. It is further desirable to provide a fishing tool that is easy to manufacture.

It is a further object to provide a fishing tool that is adaptable to a wider variety of fish diameters and can provide secure engagement with fish having a variety of different diameters. It is still a further object to provide a tool wherein, if damage to a portion of the tool occurs, replacement of the damaged portion is facilitated.

In accordance with one aspect of the present invention, an apparatus for retrieving objects from well bores is provided. The apparatus includes an uppermost segment having an internally threaded opening extending upwardly from a bottom end of the uppermost segment to a first location above the bottom end. One or more additional segments are provided, each of the additional segments having a top and a bottom end and being removably attachable, at the top end of each additional segment, to the bottom end of one of an upper one of the additional segments and the uppermost segment. Each of the additional segments has an internally threaded opening extending between the top end and the bottom end of the additional segment. Means are provided for removably securing a top end of the uppermost segment to a bottom end of a rotatable down-hole drill rod. The internally threaded openings of the uppermost and the additional segments are tapered from a first diameter at the first location in the uppermost segment to a second, larger diameter at a bottom end of a lowermost one of the additional segments.

In accordance with another aspect of the present invention, a method for retrieving an object from well bores is provided. According to the method, an uppermost segment of a retrieving apparatus is attached to a bottom end of a rotatable down-hole drill rod. The uppermost segment has an internally threaded opening extending upwardly from a bottom end of the uppermost segment to a first location above the bottom end. One or more additional segments of the retrieving apparatus are selectively attached to the uppermost segment. Each of the additional segments is removably attachable, at a top end of each additional segment, to a bottom end of one of an upper one of the additional segments and the uppermost segment. Each of the additional segments has an internally threaded opening extending between the top end and the bottom end of the additional segment. The retrieving apparatus is lowered down a well bore such that a portion of the object to be retrieved is received inside an internally threaded opening of the retrieving apparatus. The internally threaded opening of the retrieving apparatus is formed by the internally threaded openings of the uppermost and the additional segments. The object is engaged with threads of the internally threaded opening of the retrieving apparatus. The retrieving apparatus is rotated relative to the object such that threads of the internally threaded opening of the retrieving apparatus cut into the object and secure the object in the internally threaded opening of the retrieving apparatus. The retrieving apparatus in which the object is secured is removed from the well bore. The internally threaded openings of the uppermost and the additional segments are tapered from a first diameter at the first location in the uppermost segment to a second, larger diameter at a bottom end of a lowermost one of the additional segments.

In accordance with yet another aspect of the present invention, a method of making a tool for retrieving objects from a well bore is provided. According to the method, an internally threaded opening extending upwardly from a bottom end of an uppermost segment is formed in the uppermost segment. An internally threaded opening is also formed through each of one or more additional segments. The internally threaded opening in the additional segments extends from a top to a bottom end of each of the additional segments. The bottom end of the uppermost segment is secured to the top end of one of the additional segments. The internally threaded opening in the uppermost segment and the internally threaded opening in the additional segment are formed such that they are tapered to have a top diameter that is smaller than a bottom diameter.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION OF THE PREFERRED EMBODIMENT

Figure 1:
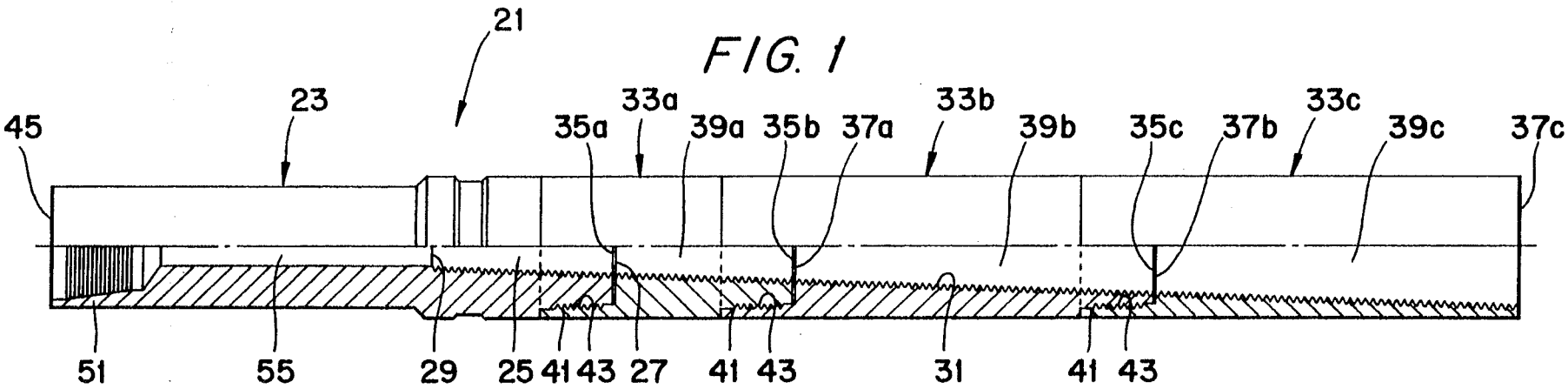
FIG. 1 is a partial cross-sectional view of a fishing tool according to an embodiment of the present invention.
Figure 3:
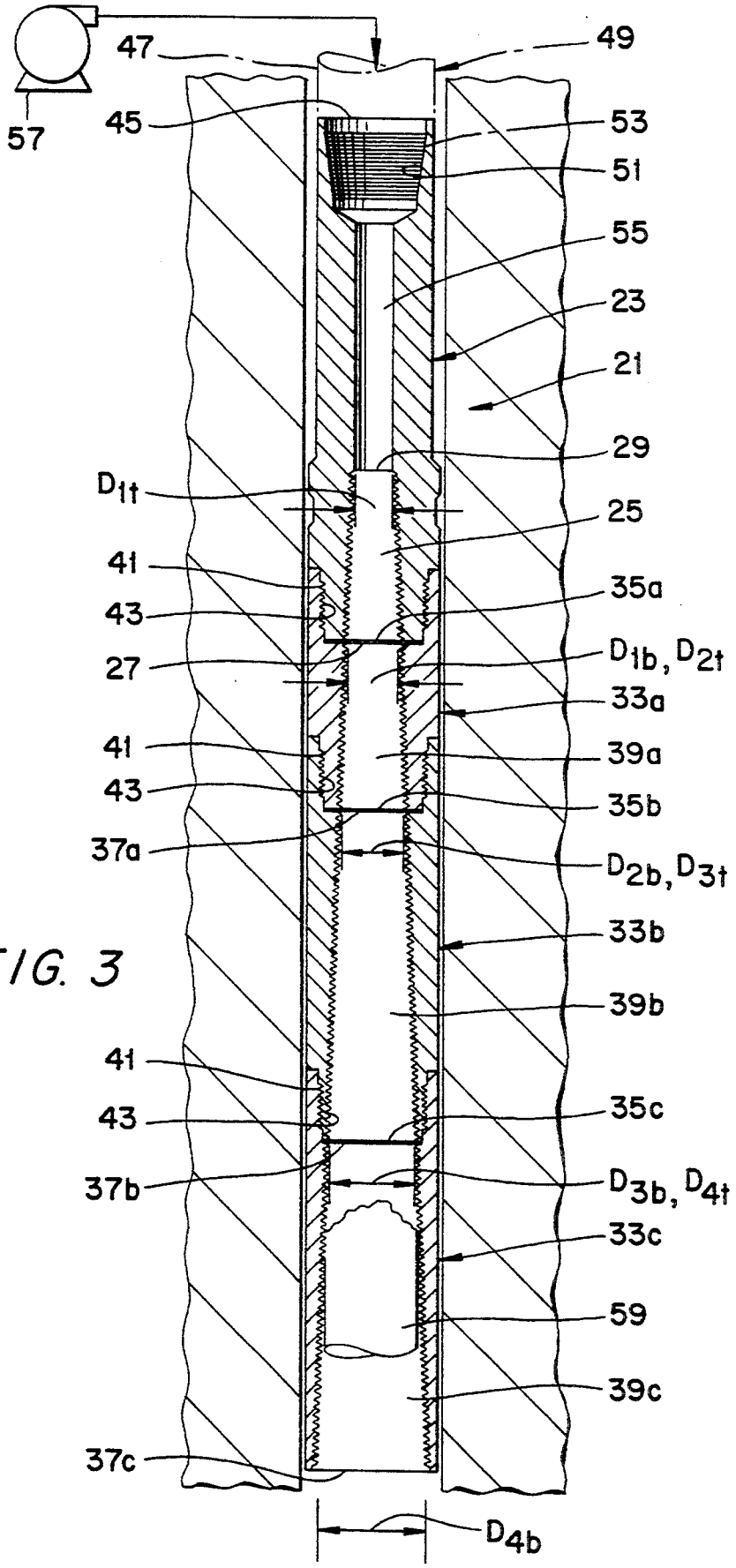
FIG. 3 is a cross-sectional view of a fishing tool according to an embodiment of the present invention showing the fishing tool engaging with a fish in a downhole operation.

A fishing tool 21 according to a preferred embodiment of the present invention is seen in cross-section with reference to FIGS. 1 and 3. All components of the fishing tool 21 are preferably made of a strong material such as steel, preferably a heat-treated alloy steel such as AISI 4140 steel. The tool 21 includes an uppermost segment 23 having an internal opening 25 extending upwardly from a bottom end 27 of the uppermost segment to a first location 29 above the bottom end. The internal opening 25 is threaded, the threads 31 preferably being a case hardened, buttress thread form.

One or more additional segments 33*a*, 33*b*, 33*c*, . . . , 33(*n*) are removably attachable, at a top end 35*a*, 35*b*, 35*c*, . . . , 35(*n*) of each additional segment, to one of the bottom end 27 of the uppermost segment 23 and a bottom end 37*a*, 37*b*, 37*c*, . . . , 37(*n*) of an upper one of the additional segments. As seen in FIGS. 1 and 3, preferably three additional segments 33*a*, 33*b*, and 33*c* are provided, the segment 33*c* being the lowermost segment. However, because any number of additional segments may be provided, the lowermost segment is also occasionally referred to herein as segment 33(*n*), for purposes of discussion only, to emphasize that more than three additional segments may be provided.

When the additional segments 33*a*, 33*b*, 33*c*, . . . , 33(*n*) and the uppermost segment 23 of the fishing tool 21 are attached to one another, the thread 31 is preferably continuous, i.e., an end of the thread at a bottom end of one of the segments mates with an end of the thread at a top end of an attached one of the segments. In this manner, when a fish is first threaded by threads 31 in a lower one of the segments and is then further forced or drawn into an upper one of the segments as the fishing tool 21 is turned relative to the fish, the threads in the upper one of the segments are received in the already-formed threads on the fish. If desired, the fishing tool 21 is provided with alignment structures such as pins and holes or keys and slots for ensuring that the various segments of the fishing tool are aligned relative to one another such that the thread 31 is continuous. As explained below, the ends of the segments are preferably threaded for attachment of the segments and, preferably, the threads provided for attachment of the segments are formed to ensure that, when the segments are tightly joined to one another and ends of the segments "shoulder up", the thread 31 is continuous.

Each of the additional segments 33*a*, 33*b*, 33*c*, . . . , 33(*n*) have internally threaded openings 39*a*, 39*b*, 39*c*, . . . , 39(*n*) extending between the top ends and the bottom ends of the additional segments. The internally threaded openings 25 and 39*a*, 39*b*, 39*c*, . . . , and 39(*n*) of the uppermost and the additional segments 23 and 33*a*, 33*b*, 33*c*, . . . , and 33(*n*) are tapered from a first diameter $D_{1t}$ at the first location 29 in the uppermost segment to a second, larger diameter $D_{(nb)}$ at the bottom end 37(*n*) of the lowermost one of the additional segments.

As seen in FIGS. 1 and 3, the taper of the internally threaded openings 25, 39*a*, 39*b*, 39*c*, . . . , 39(*n*) of each of the uppermost and additional segments 23, 33*a*, 33*b*, 33*c*, . . . , 33(*n*) is preferably continuous. Accordingly, the individual segments 23, 33*a*, 33*b*, 33*c*, . . . , 33(*n*) each have a smaller top diameter and a larger bottom diameter. More particularly, the internally threaded opening 25 of the uppermost segment 23 has the top diameter $D_{1t}$ and a larger bottom diameter $D_{1b}$, the first additional segment 33*a* has a top diameter $D_{2t}$ and a larger bottom diameter $D_{2b}$, and so on to the lowermost additional segment 33(*n*), which has a top diameter $D_{(n)t}$ and the bottom diameter $D_{(n)b}$. The bottom of the uppermost segment 23 mates with the top of the first additional segment 33*a*, and the bottom diameter $D_{1b}$ of the uppermost segment is preferably substantially the same size as the top diameter $D_{2t}$ of the first additional segment, and so on to the lowermost additional segment and the next to lowermost additional segment.

The bottom diameters of the internally threaded openings of upper ones of the segments 23, 33*a*, 33*b*, 33*c*, . . . , 33($n-1$) are preferably substantially the same size as the top diameters of the internally threaded openings of adjacent ones of the segments 33*a*, 33*b*, 33*c*, . . . , 33(*n*) so that a continuous taper is formed. If desired, such as when the size of the fish is known, or a particular size of additional segment is unavailable, the taper of the opening formed by attached segments may be made discontinuous, such as by attaching, to the bottom of the uppermost segment, an additional segment having an internal opening having a larger top diameter than the bottom diameter of the internal opening of the uppermost segment. However, it is preferred to provide a continuous taper so that fish received in the internal opening will, upon rotating the fishing tool 21, be tapped to the greatest amount possible by the thread 31 of the fishing tool.

Figure 2:
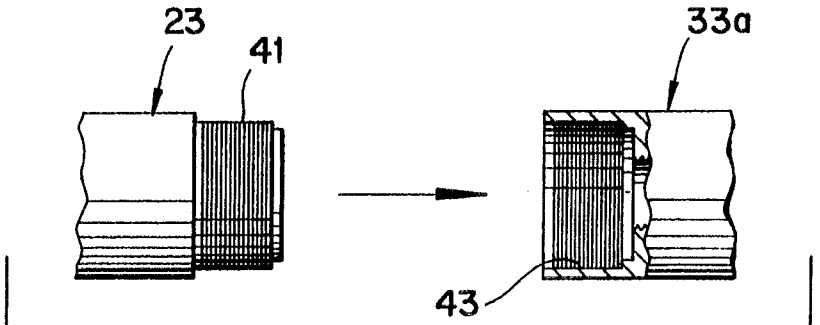
FIG. 2 is a partial cross-sectional view of engagable top and bottom portions of segments of a fishing tool according to an embodiment of the present invention.

The uppermost segment 23 and the additional segments 33*a*, 33*b*, 33*c*, . . . , 33(*n*) are preferably attachable to one another by threaded portions at the bottom end 27 of the uppermost segment, at the top ends 35*a*, 35*b*, 35*c*, . . . , 35(*n*) of all of the additional segments, and at the bottom ends of at least some of the additional segments 37*a*, 37*b*, 37*c*, . . . 37(*n*−1). As seen in FIG. 2, which shows, for purposes of example, the attachment of the bottom end 27 of the uppermost segment 23 to the top end 35*a* of the first additional segment 33*a*, the bottom end of the uppermost segment is preferably provided with an external thread 41 and the top end of the first additional segment is preferably provided with a mating internal thread 43. Such an attachment arrangement offers a strong attachment capable of distributing stresses in the segments that are developed during operation. Moreover, as noted above, the external and internal threads 41 and 43 facilitate lining up the threads 31 on the uppermost segment 23 and the additional segments 33*a*, 33*b*, 33*c*, . . . , 33(*n*).

If desired, of course, other attachment arrangements instead of mating threaded ends of the upper and lower segments may be used, such as pin and hole arrangements, key and slot arrangements, and the like. Further, if desired, the uppermost segment 23 and the additional segments 33*a*, 33*b*, 33*c*, . . . , and 33(*n*) are designed to be attachable to one another only in such a manner as to form a continuous taper. For example, the external threads 41 and internal threads 43 at ends of the various segments may be sized to engage only with threads of a particular one of the segments.

As seen in FIG. 3, the top end 45 of the uppermost segment 23 is adapted to be removably secured to a bottom end 47 of a down-hole drill rod 49. As with the attachment of the uppermost and additional segments 23, 33*a*, 33*b*, 33*c*, . . . , 33(*n*), described above, any suitable attachment structure may be provided. For example, as seen in FIG. 3, the top end 45 of the uppermost segment 23 is provided with an internal thread 51 and the bottom end 47 of the drill rod 49 is provided with a mating external thread 53.

The uppermost segment 23 is preferably provided with a second opening portion 55 extending from the first location 29 to the top end 45 of the uppermost segment. For purposes of discussion, the second opening portion 55 is considered to include any portions such as the internally threaded opening 51 for removably attaching the bottom end 47 of the drill rod 49. The drill rod 49 is preferably a hollow rod so that the second opening portion 55 permits communication between the interior of the drill rod and the tapered internal openings of the fishing tool 21. A pump 57 or similar device is preferably provided for providing fluid such as water through the drill rod and into the second opening portion 55 for cooling and lubrication of the fish 59 and the threads 31 and for wetting a well bore in which the fishing tool 21 is used. In this manner, the earth in the well bore is softened by the water, facilitating lowering or forcing the fishing tool 21 down around the fish 59.

A preferred fishing tool 21 includes four segments, namely, the uppermost segment 23, a first additional segment 33*a*, a second additional segment 33*b*, and a third additional (and lowermost) segment 33*c*, however, any number of segments may be provided as desired. The internally threaded opening 25 of the uppermost segment 23 is preferably approximately 6″ in length, and the second opening portion 55 is preferably approximately 12″ in length, although any desired length may be provided.

The internally threaded opening 39*a* of the first additional segment 33*a* is preferably approximately 6″ in length, and the internally threaded openings of the second and third additional segments are each preferably approximately 12″ in length although, again, any desired length may be provided. To facilitate machining, the tapered internal openings of individual ones of the uppermost segment and the additional segments are preferably no more than approximately 12″ in length, although greater lengths, such as lengths of approximately 20″ or more, may be provided for particular applications. By providing the uppermost segment 23 and additional segments 33*a*, 33*b*, 33*c*, . . . , 33(*n*) in relatively short lengths, it is possible to provide a long, low-angle taper adapted to engage a fish with multiple threads at a low cost relative to a similar, single piece device. For example, it is relatively simple to form a low-angle taper in a number of segmented members that are attachable to one another so that the assembled tool has the long, low-angle taper, whereas providing a similar taper in a single piece tool is quite complex. Further, if individual ones of the uppermost and additional segments become damaged, it is possible to replace only the damaged segments without having to scrap the entire tool.

The overall length of the tapered internal opening formed by the internal opening 25 and the internal openings 39*a*, 39*b*, and 39*c* is preferably approximately 36″, or between approximately 20″ and 60″, however, the tapered internal opening may be any desired length and formed by any desired number of segments. The overall length of the fishing tool 21 is preferably approximately 48″ when the overall length of the tapered internal opening is approximately 36″. The low-angle taper of the internally threaded openings 25 and 39*a*, 39*b*, 39*c*, . . . , and 39(*n*) is preferably between approximately 0.5° and 5.5°, however, greater or smaller angles may be provided as desired or necessary.

Most other dimensions of the fishing tool 21 are functions of the type of casing in which the tool is used. For example, different fishing tools are used in the various weights of, e.g., 4 ½″, 5 ½″, and 7″ casings. In, for example, a 5 ½″ O.D., 20 lb. weight (weight per foot, including couplings) casing, the outside diameter of the fishing tool 21 is preferably approximately 4 11/16″ at its widest point. The top diameter of the tapered internal opening formed by the internal openings 25, 39*a*, 39*b*, and 39*c*, at the first location 29, is preferably between 1.25″ and 1.7″, and the bottom diameter of the tapered internal opening, at the bottom end 37*c* of the additional segment 33*c*, is preferably approximately 3 15/16″. The tapered internal opening preferably tapers at an angle in a range between approximately 2.2° and 1.0°, and the thread 31 is preferably a ten thread per inch thread. The fishing tool 21 having the above-noted dimensions is presently preferred for most applications involving the above-noted diameter and weight of casing because the length of the tool and the range of inside diameters of the tapered, internal opening permits retrieval of fish having a wide range of sizes, as well as engagement of the fish 59 with a large number of threads. Of course, factors such as the angle of taper, the number of segments, the length of segments, and the internal and external diameters of segments will preferably be varied to accommodate particular applications.

According to a method of using the fishing tool 21 to retrieve fish 59, the fishing tool 21 is attached to the bottom end 47 of the down-hole drill rod 49. The fishing tool 21 is lowered down a well bore, as seen in FIG. 3, such that a portion of the fish 59 is received inside the internally threaded opening 25, 39*a*, 39*b*, and 39*c* of at least one of the uppermost and the additional segments 23, 33*a*, 33*b*, 33*c*. The fishing tool 21 is preferably lowered down the well bore with a conventional drilling apparatus, which includes the drill rod 49 to which the fishing tool is attached. The drill rod 49 is rotatable when desired or necessary.

When a portion of the fish 59 is received in the tapered opening of the fishing tool 21, the fishing tool is rotated relative to the object such that thread 31 cuts into the fish and secures or engages the fish in a portion of the tapered opening. The fishing tool 21 in which the fish 59 is secured is then withdrawn from the well bore. Ordinarily, the fish 59 will be restricted in movement by the additional engagement with the fishing tool 21 prior to rotation thereof and, after the thread 31 of the fishing tool initially engages with the fish and upon rotation of the fishing tool, the fish is drawn further upward into the fishing tool, thereby providing a secure engagement between the fishing tool and the fish. As noted above, it is preferred to inject a fluid, usually water, into the well bore through the down-hole drill rod 49 and the fishing tool 21 to wet the well bore and cool and lubricate the fish 59 and the fishing tool.

The provision of a relatively small taper angle over a relatively long taper length permits engagement by the fishing tool 21 with the fish 59 by a plurality of threads 31. Further, the reduced taper angle permits minimization of stresses on the threads, in contrast to conventional box tap devices where the fish is engaged by relatively few threads.

If, during use, individual ones of the uppermost segment 23 or the additional segments 33*a*, 33*b*, 33*c*, . . . , 33(*n*) become damaged, the fishing tool 21 is easily repaired by replacing the particular damaged one of the segments. Accordingly, unlike known fishing tools, the fishing tool 21 of the present invention need not be completely replaced whenever a portion of the fishing tool is damaged. Under the harsh use conditions of the fishing tool 21, the ability to replace individual damaged segments, as opposed to an entire tool, permits a great cost savings in view of the expense involved in the machining of tapered, threaded internal bores.

According to a method of making the fishing tool 21, the internally threaded opening 25 is formed in the bottom end 27 of the uppermost segment 23. Internally threaded openings 39*a*, 39*b*, 39*c*, . . . , 39(*n*) are formed through one or more additional segments 33*a*, 33*b*, 33*c*, . . . , 33(*n*), and extend from the top ends 35*a*, 35*b*, 35*c*, . . . , 35(*n*) to the bottom ends 37*a*, 37*b*, 37*c*, . . . , 37(*n*) of the additional segments. The internally threaded openings 25, 39*a*, 39*b*, . . . , 39(*n*) are preferably formed with a known boring bar apparatus having a boring bar with a length at least as great as the length of any one of the internally threaded openings. The thread 31 of the internally threaded openings 25 39*a*, 39*b*, 39*c*, 39(*n*) is preferably case hardened.

The bottom end 27 of the uppermost segment 23 is secured to the top end 35*a* of the first one of the additional segments 33*a*. The top end 35*b* of a second one of the additional segments 33*b* is secured to the bottom end 37*a* of the first additional segment 33*a* and so on until the fishing tool 21 is of a desired length and includes additional segments having desired internal diameters.

While this invention has been illustrated and described in accordance with a preferred embodiment, it is recognized that variations and changes may be made therein without departing from the invention as set forth in the claims.

What is claimed is:

1. An apparatus for retrieving objects from well bores, comprising:

an uppermost segment having an internally threaded opening extending upwardly from a bottom end of the uppermost segment to a first location above the bottom end;

one or more additional segments, each of the additional segments having a top and a bottom end and being removably attachable, at the top end of each additional segment, to the bottom end of one of an upper one of the additional segments and the uppermost segment, each of the additional segments having an internally threaded opening extending between the top end and the bottom end of the additional segment;

means for removably securing a top end of the uppermost segment to a bottom end of a rotatable down-hole drill rod; and the internally threaded openings of the uppermost and the additional segments being tapered from a first diameter at the first location in the uppermost segment to a second, larger diameter at a bottom end of a lowermost one of the additional segments.

2. The apparatus as set forth in claim 1, wherein internal diameters of the internally threaded openings of an adjacent, bottom and top ends of attached upper and lower ones, respectively, of the uppermost and the additional segments of the retrieving apparatus are substantially the same.

3. The apparatus as set forth in claim 2, wherein a thread of the retrieving apparatus formed by threads on the internally threaded openings of the attached uppermost and additional segments is continuous.

4. The apparatus as set forth in claim 1, wherein a taper angle of the internally threaded openings is in a range between 0.5° and 5.5°.

5. The apparatus as set forth in claim 1, wherein the internally threaded openings of the uppermost and the additional segments define an internally threaded opening 20″ or greater in length.

6. The apparatus as set forth in claim 1, wherein the internally threaded openings of the uppermost and the additional segments define an internally threaded opening 36″ or greater in length.

7. The apparatus as set forth in claim 1, wherein the internally threaded openings of the uppermost and the additional segments are, individually, 20″ or shorter in length.

8. The apparatus as set forth in claim 1, wherein the internally threaded openings of the uppermost and the additional segments are, individually, 12″ or shorter in length.

9. The apparatus as set forth in claim 1, wherein the uppermost and the additional segments are attachable by thread means at the bottom end of the uppermost segment, at the top ends of all of the additional segments, and at the bottom ends of at least some of the additional segments.

10. The apparatus as set forth in claim 1, wherein the securing means includes a threaded portion at the top end of the uppermost segment for mating with a corresponding threaded portion on the bottom end of the down-hole drill rod.

11. The apparatus as set forth in claim 10, wherein the threaded portion is an internally threaded portion for mating with a corresponding externally threaded portion on the bottom end of the down-hole drill rod.

12. The apparatus as set forth in claim 1, wherein the threads are case hardened.

13. The apparatus as set forth in claim 1, wherein the uppermost segment is provided with an internal opening at a top of the uppermost segment, the internal opening permitting fluid to pass into the internally threaded openings of the uppermost and the additional segments.

14. A method for retrieving an object from well bores, comprising the steps of:

attaching, to a bottom end of a rotatable down-hole drill rod, an uppermost segment of a retrieving apparatus, the uppermost segment having an internally threaded opening extending upwardly from a bottom end of the uppermost segment to a first location above the bottom end;

selectively attaching one or more additional segments of the retrieving apparatus to the uppermost segment, each of the additional segments being removably attachable, at a top end of each additional segment, to a bottom end of one of an upper one of the additional segments and the uppermost segment, each of the additional segments having an internally threaded opening extending between the top end and the bottom end of the additional segment;

lowering the retrieving apparatus down a well bore such that a portion of the object to be retrieved is received inside an internally threaded opening of the retrieving apparatus, the internally threaded opening of the retrieving apparatus being formed by the internally threaded openings of the uppermost and the additional segments;

engaging the object with threads of the internally threaded opening of the retrieving apparatus;

rotating the retrieving apparatus relative to the object such that threads of the internally threaded opening of the retrieving apparatus cut into the object and secure the object in the internally threaded opening of the retrieving apparatus; and removing the retrieving apparatus in which the object is secured from the well bore, wherein the internally threaded openings of the uppermost and the additional segments are tapered from a first diameter at the first location in the uppermost segment to a second, larger diameter at a bottom end of a lowermost one of the additional segments.

15. The method as set forth in claim 14, further comprising the step of injecting a fluid into the well bore through the down-hole drill rod and the retrieving apparatus.

16. The method as set forth in claim 15, wherein internal diameters of the internally threaded openings of an adjacent, bottom and top ends of attached upper and lower ones, respectively, of the uppermost and the additional segments of the retrieving apparatus are substantially the same.

17. The method as set forth in claim 16, wherein the uppermost and additional segments are attached relative to one another such that a thread of the retrieving apparatus formed by threads on the internally threaded openings of the attached uppermost and additional segments is continuous.

18. A method of making a tool for retrieving objects from a well bore, comprising the steps of:

forming an internally threaded opening extending upwardly from a bottom end of an uppermost segment;

forming one or more additional internally threaded openings through each of one or more additional segments, the additional internally threaded openings extending from a top to a bottom end of each of the additional segments; and securing the bottom end of the uppermost segment to the top end of one of the additional segments, wherein the internally threaded opening in the uppermost segment and the additional internally threaded openings in the additional segments are formed such that they are tapered to have a top diameter that is smaller than a bottom diameter.

19. The method as set forth in claim 18, further comprising the step of securing a top end of another one of the additional segments to a bottom end of the additional segment secured to the uppermost segment.

20. The method as set forth in claim 19, wherein the taper is formed such that the bottom diameter of the internally threaded opening of the uppermost segment is substantially the same size as the top diameter of the internally threaded opening of an adjacent one of the additional segments to which the uppermost segment is secured.

21. The method as set forth in claim 20, wherein the bottom end of the uppermost segment is secured to the top end of the attached adjacent one of the additional segments such that a thread of the tool formed by the attached uppermost and additional segment is continuous.

22. The method as set forth in claim 18, further comprising the step of case hardening threads of the internally threaded openings.

* * * * *